US009204237B2

(12) United States Patent
Amadu et al.

(10) Patent No.: US 9,204,237 B2
(45) Date of Patent: Dec. 1, 2015

(54) METHOD OF GENERATING LEFT AND RIGHT SURROUND SIGNALS FROM A STEREO SOUND SIGNAL

(75) Inventors: Frédéric Amadu, Paris (FR); Thomas Esnault, Paris (FR)

(73) Assignee: ARKAMYS, Paris (FR)

( * ) Notice: Subject to any disclaimer, the term of this patent is extended or adjusted under 35 U.S.C. 154(b) by 487 days.

(21) Appl. No.: 13/518,923

(22) PCT Filed: Dec. 21, 2010

(86) PCT No.: PCT/FR2010/052864

§ 371 (c)(1),
(2), (4) Date: Jun. 25, 2012

(87) PCT Pub. No.: WO2011/077040

PCT Pub. Date: Jun. 30, 2011

(65) Prior Publication Data

US 2012/0263327 A1 Oct. 18, 2012

(30) Foreign Application Priority Data

Dec. 23, 2009 (FR) ..... 09 59554

(51) Int. Cl.
*H04S 5/02* (2006.01)

(52) U.S. Cl.
CPC ..... *H04S 5/02* (2013.01)

(58) Field of Classification Search
USPC ..... 381/307, 63
See application file for complete search history.

(56) References Cited

U.S. PATENT DOCUMENTS

| | | | | | |
|---|---|---|---|---|---|
| 4,352,954 | A | * | 10/1982 | Franssen et al. | 381/63 |
| 4,366,346 | A | * | 12/1982 | Dijkmans et al. | 381/63 |
| 5,136,917 | A | * | 8/1992 | Kunimoto | 84/624 |
| 5,432,296 | A | * | 7/1995 | Takeuchi et al. | 84/661 |
| 5,641,931 | A | * | 6/1997 | Ogai et al. | 84/661 |
| 5,671,287 | A | * | 9/1997 | Gerzon | 381/17 |
| 5,708,718 | A | * | 1/1998 | Ambourn et al. | 381/1 |
| 5,970,153 | A | * | 10/1999 | Petroff | 381/17 |
| 6,026,169 | A | * | 2/2000 | Fujimori | 381/61 |
| 7,149,314 | B2 | * | 12/2006 | Dahl et al. | 381/63 |

(Continued)

FOREIGN PATENT DOCUMENTS

| | | | |
|---|---|---|---|
| EP | 1848247 | A2 | 10/2007 |
| JP | 62258599 | A | 11/1987 |

(Continued)

*Primary Examiner* — Fan Tsang
*Assistant Examiner* — Angelica M McKinney
(74) *Attorney, Agent, or Firm* — Im IP Law PLLC; C. Andrew Im

(57) ABSTRACT

A method of generating left (Ls) and right (Rs) sound signals known as "surround" signals from a stereo sound signal composed of a left sound signal and of a right sound signal. One of the stereo signals is subtracted from the other signal with the aid of a subtraction module to obtain a single subtraction signal (LR) in which the correlated and in-phase components of the stereo signals (L, R) have been removed. A right sound signal (Rs) and a left sound signal (Ls) are generated from the subtraction signal (L−R), these signals being decorrelated with respect to one another and corresponding respectively to the right and left sound "surround" signals. These "surround" signals (Ls, Rs) intend for broadcast on the rear channels of an acoustic system.

10 Claims, 2 Drawing Sheets

(56) References Cited

U.S. PATENT DOCUMENTS

| | | | | |
|---|---|---|---|---|
| 7,177,431 | B2 * | 2/2007 | Davis et al. | 381/1 |
| 2002/0106090 | A1 * | 8/2002 | Dahl et al. | 381/63 |
| 2003/0021423 | A1 * | 1/2003 | Wood | 381/18 |
| 2006/0210087 | A1 * | 9/2006 | Davis et al. | 381/17 |
| 2010/0303245 | A1 * | 12/2010 | Vickers | 381/17 |

FOREIGN PATENT DOCUMENTS

| | | | |
|---|---|---|---|
| JP | 64000900 | A | 1/1989 |
| JP | 1144900 | A | 6/1989 |
| JP | 2006 217210 | A | 8/2006 |
| JP | 2007 336118 | A | 12/2007 |

* cited by examiner

METHOD OF GENERATING LEFT AND RIGHT SURROUND SIGNALS FROM A STEREO SOUND SIGNAL

RELATED APPLICATIONS

This application is a §371 application from PCT/FR2010/052864 filed Dec. 21, 2010, which claims priority from French Patent Application No. 09 59554 filed Dec. 23, 2009, each of which is incorporated herein by reference in its entirety.

TECHNICAL FILED OF THE INVENTION

The invention relates to a method for generating left and right "surround" sound signals from a stereo signal, said left and right "surround" sound signals being intended to be broadcasted by means of an acoustic system of the type 5.1. The purpose of the invention is in particular to propose a method for processing a surround sound in order to get a good sound rendering while using few resources.

The invention finds a particularly advantageous application in the field of sound processing for home-cinema, stereo equipment, computers, mobile telephones or any other device having a sound broadcasting system with capacities of calculation, limited or not, for the sound processing.

BACKGROUND OF THE INVENTION

It is pointed out that a 5.1 broadcasting system is an acoustic system including two (left and right) front channels, two (left and right) rear channels, a Low Frequency Effect channel, as well as a central channel. The sound broadcasted by this kind of system is a so-called "surround" sound which provides a listener with a sound envelopment feeling.

OBJECT AND SUMMARY OF THE INVENTION

The invention is described hereafter in an application for acoustic systems of the type 5.1, it could however be implemented with any other acoustic system based on the generation of sound signals aiming at providing a listener with a sound envelopment feeling.

More precisely, it is possible to consider that the left and right sound signals forming a stereo signal are each made up of 3 distinct components:

- a component decorrelated relative to that of the other signal, said component being intended to be broadcast by the front channels of a system of the type 5.1;
- a component correlated and in-phase relative to that of the other signal, said component being intended to be broadcasted by the central channel of a system of the type 5.1; and
- a component called "surround" component correlated and out-phase relative to that of the other signal, said component being normally intended to be broadcasted by the rear channels of a system of the type 5.1.

The purpose of the invention is to generate these surround components in order to reproduce a sound surround effect with a good quality while limiting computing time during the extraction of these components.

For this purpose, in the method according to the invention, a subtraction of the left and right stereo sound signals from one another is carried out, so as to suppress the correlated and in-phase common component from the stereo signals. Then, the signal resulting from this step of subtraction is decorrelated by means of a decorrelation module, so as to obtain the left and right "surround" components of the stereo signal which are ready to be broadcasted, if necessary after a parametric equalization, by the rear channels of a system of the type 5.1.

Moreover, the compromise between the computing power of the processing and the "surround" sound effect obtained is excellent with the method according to the invention.

The invention thus relates to a method for generating left and right sound signals called "surround" signals from a stereo sound signal made up of a left sound signal and a right sound signal, characterized in that it comprises the following steps:

- one of the stereo signals is subtracted from the other signal by means of a subtraction module to obtain a single subtraction signal in which the correlated and in-phase components of the stereo signals have been suppressed,
- a right sound signal and a left sound signal decorrelated relative to one another which respectively correspond to the right and left "surround" sound signals are generated from the subtraction signal.

According to an embodiment, the "surround" signals are intended to be broadcasted by the rear channels of an acoustic system of the type 5.1.

According to an embodiment, for generating from the subtraction signal the right and left "surround" sound signals decorrelated relative to one another,

- the subtraction signal is applied to the input of a first and a second elementary block, the output signal of these blocks respectively corresponding to the right surround sound signal and to the left surround sound signal,
- the output signal of each block is the combination of the input signal of the block weighted by a first gain, and of the combination of the output signal of the block weighted by a second gain and the input signals of the block delayed by a delay line.

According to an embodiment:

for the first elementary block:

$$s_1(n)=e_1(n)\cdot g_1+S_1(n-D1)\cdot g_2+e_1(n-D1),$$

$e_1$ being the input signal of the first block corresponding to the subtraction signal, $s_1$ being the output signal of the first block corresponding to one of the surround sound signals (right or left), $g_1$, $g_2$ being respectively the values of the first gain and the second gain of the first block, n being the $n^{th}$ harmonic sample, $D_1$ being the value of the number of delay samples introduced by the delay line, and for the second elementary block:

$$s_2(n)e_2(n)\cdot g_3+s_2(n-D_2)\cdot g_4+e_2(n-D2),$$

$e_2$ being the input signal of the second block corresponding to the subtraction signal, $s_2$ being the output signal of the second block corresponding to the other surround sound signal (right if $s_1$ corresponds to the left one or left if $s_1$ corresponds to the right one), $g_3$, $g_4$ being respectively the values of the first gain and the second gain of the second block, n being the $n^{th}$ harmonic sample D2 being the value of the number of delay samples introduced by the delay line.

According to an embodiment, the gain values inside a block are opposite one another, the value of the first gain being opposite the value of the second gain.

According to an embodiment, the gain values of the first block are opposite the gain values of the second block, the value of the first gain of the first block being opposite the value of the first gain of the second block; while the value of the second gain of the first block is opposite the value of the second gain of the second block.

According to an embodiment, the gain values of the first and second elementary block have the same absolute value.

According to an embodiment, the first gain of the first block and the second gain of the second block are equal to g; while the second gain of the first block and the first gain of the second block are equal to −g.

According to an embodiment, the delay introduced by the delay line of the first block and the delay introduced by the delay line of the second block are equal to each other.

According to an embodiment, the subtraction signal is first filtered by means of a high-pass filter and only the high frequency part filtered is applied to the inputs of the elementary blocks.

According to an embodiment,

- the low frequency part of the left and right signals of the stereo signal is filtered,
- the low frequency parts thus filtered is delayed with a delay by means of third delay lines, and
- the low frequency part thus delayed is added to the output signals of the elementary blocks to obtain the right surround sound signal and the left surround sound signal.

According to an embodiment, the phase and the gain of the output signals of each elementary block is modified according to the frequency by means of parametric filtering cells for modifying the sound perception of the left and right surround sound signals.

The invention moreover relates to a method for generating surround signals to be broadcasted by an acoustic system composed of a front/rear loudspeaker from a stereo sound signal made up of a left sound signal and a right sound signal, wherein said method includes the following step:

- the "surround" sound signals are generated by means of said method for generating left and right sound signals called "surround" signals from a stereo sound signal made up of a left sound signal and a right sound signal and said "surround" sound signals are applied to the rear channels of the acoustic system.

BRIEF DESCRIPTION OF THE DRAWINGS

The invention will be better understood when reading the following description and examining the annexed figures. These figures are given only as an illustration but by no means as a restriction of the invention. They show.

Identical elements have the same reference throughout the figures.

DETAILED DESCRIPTION OF THE EMBODIMENTS

Figure 1:
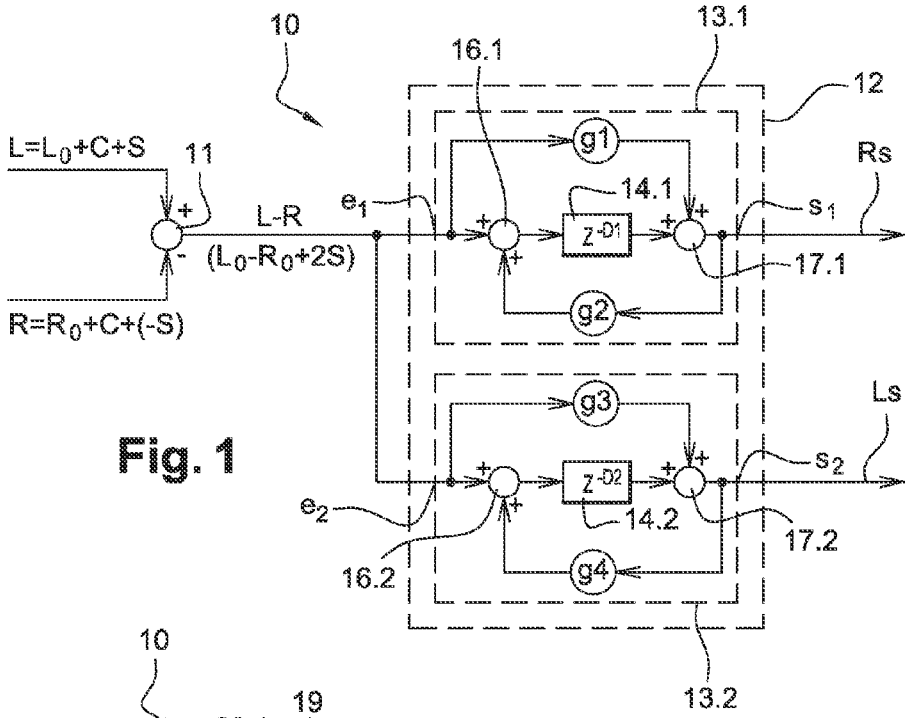
FIG. 1: a schematic representation of a device according to the invention allowing the extraction of the "surrounds" components of a stereo sound signal in a basic version.

FIG. 1 shows a device 10 according to the invention making it possible to generate a left sound signal $L_s$ and a right sound signal $R_s$ called "surround" signals from a stereo sound signal formed of a left sound signal L and of a right sound signal R.

One considers that the left sound signal L and the right sound signal R are respectively formed of a sum of 3 components:

$L=L_0+C+S$ for the left signal L, and $R=R_0+C+(-S)$ for the right signal R.

- The components $L_0$ and $S_0$ are the components decorrelated relative to one another,
- The component C is common to both signals L and R since it corresponds to the correlated and in-phase components of the signals L and R,
- The component S corresponds to the correlated and out-phase component of the signals L and R.

Figure 3:
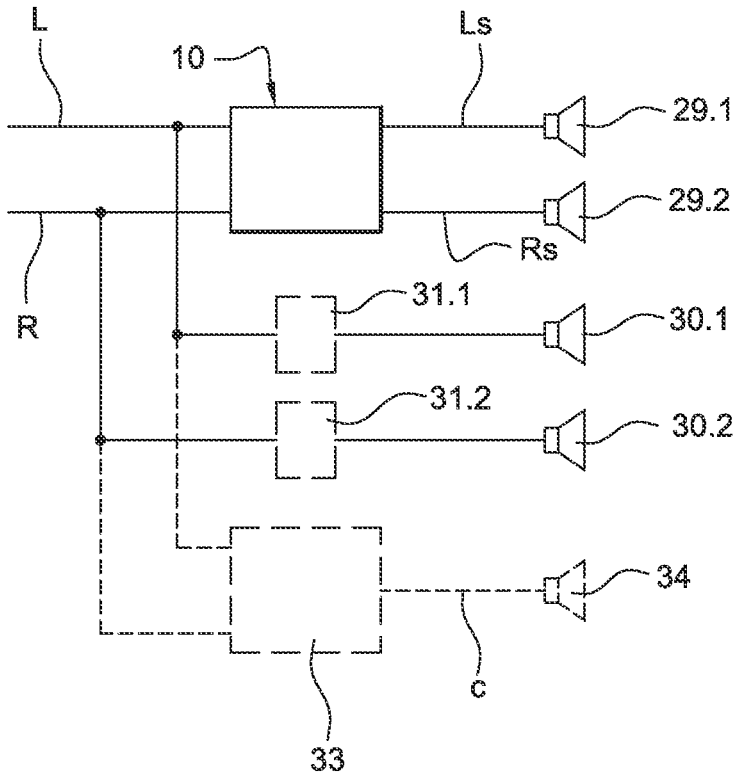
FIG. 3: a schematic representation of a device according to the invention allowing to generate from a stereo sound signal sound signals that can be broadcasted by an acoustic system of the type 5.1.

The purpose of the invention is to isolate the component S and to generate two decorrelated components in order to broadcast them in channels distinct from those in which the stereo signals L and R are broadcasted in order to provide the listener with an envelopment effect (cf. FIG. 3).

For this purpose, the left L and right R signals are applied to the input of a subtracter 11 in order to suppress the left component C from the L and right R signals and to keep only the component $L_0$, $R_0$ and the component S of the stereo signals L and R. Here, the right sound signal R is subtracted from the left sound signal L (L−R), but it would be possible to carry out the opposite operation (R−L).

The subtraction signal L−R obtained at the output of the subtracter 11 is then applied to the input of a decorrelation module 12 of the signal which makes it possible to generate from the subtraction signal L−R two signals decorrelated relative to one another: the left "surround" sound signal $L_s$ and the right "surround" sound signal $R_s$.

For this purpose, the decorrelation module 12 is made of two elementary blocks 13.1-13.2 to the inputs of which the subtraction signal L−R is applied, the output $s_1$, $S_2$ of these blocks 13.1, 13.2 respectively corresponding to the right surround sound signal Rs and to the left surround sound signal Ls. The output signal $s_1$ (resp. $s_2$) of each block 13.1 (resp. 13.2) depends on the input signal $e_1$ (resp. $e_2$) of the block weighted by a first gain $g_1$ (resp. $g_3$), and of the combination of the input signals $e_1$ (resp. $e_2$) and output signals $s_1$ (resp. $s_2$) of the block weighted by a second gain $g_2$ (resp. $g_4$), delayed by a delay line 14.1 (resp. 14.2).

According to an embodiment, for each elementary block 13.1, 13.2, the input signal $e_1$, $e_2$ is applied to the input of a first adder 16.1, 16.2 and is applied to an input of a second adder 17.1, 17.2 after being multiplied by the first gain $g_1$, $g_3$. The output signal $s_1$, $s_2$ of the block is applied to another input of the first adder 16.1, 16.2 after being multiplied by the second gain $g_2$, $g_4$, the output signal of the first adder 16.1, 16.2 being applied to the input of the delay line 14.1, 14.2. The output signal of the delay line 14.1, 14.2 is applied to another input of the second adder 17.1, 17.2, the output signal of this second adder 17.1, 17.2 corresponding to the output signal $s_1$, $s_2$ of the block and thus to the right $R_S$ or left $L_S$ surround sound signal.

Thus for the first elementary block 13.1:

$$s_1(n)=e_1(n)\cdot g_1+s_1(N-D1)\cdot g_2+e_1(n-D1)$$

$e_1$ being the input signal of the first block 13.1 corresponding to the subtraction signal (L−R), $s_1$ being the output signal of the first block 13.1 corresponding to one of the surround sound signals (right $R_s$ or left $L_s$), $g_1$, $g_2$ being respectively the values of the first gain and the second gain of the first block 13.1, n being the $n^{th}$ harmonic sample, D1 being the value of the number of delay samples introduced by the delay line 14.1.

For the second elementary block 13.2:

$$s_2(n)e_2(n)\cdot g_3+s_2(n-D2)\cdot g_4+e_2(n-D2)$$

$e_2$ being the input signal of the second block 13.2 corresponding to the subtraction signal (L−R), $s_2$ being the output signal of the second block 13.2 corresponding to the other surround sound signal (right Rs if $s_1$ corresponds to the left one; or left Ls if $s_1$ corresponds to the right one), $g_3$, $g_4$ being respectively the values of the first gain and the second gain of the second block 13.2, n being the $n^{th}$ harmonic sample, D2 being the value of the number of delay samples introduced by the delay line 14.2.

Preferably, inside the same block 13.1 (resp. 13.2), the first gain $g_1$ (resp. $g_3$) and the second gain $g_2$ (resp. $g_4$) have values opposite one another. Each block 13.1, 13.2 behaves then as a filter of the all-pass type which does not modify the gain of the input signal $e_1$, $e_2$ but only the phase thereof.

Moreover, the gains $g_1$, $g_2$ of the first block 13.1 and the gains $g_3$, $g_4$ of the second block 13.2 preferably have values opposite one another. Thus, the value of the first gain $g_1$ of the first block 13.1 is opposite the value of the first gain $g_3$ of the second block 13.2; while the value of the second gain $g_2$ of the first block 13.1 is opposite the value of the second gain $g_4$ of the second block 13.2.

One will also preferably choose gains for the first 13.1 and the second 13.2 block which have an identical absolute value g. Thus, preferably, the first gain $g_1$ of the first block 13.1 and the second gain $g_4$ of the second block 13.2 have a value g; while the second gain $g_2$ of the first block 13.1 and the first gain $g_3$ of the second block 13.2 have a value −g.

Preferably, the delays D1, D2 introduced by the delay line 14.1 of the first elementary block 13.1 and the delay line 14.2 of the second elementary block 13.2 are equal to each other. However, it would be possible to choose delays D1, D2 with different durations.

In an embodiment example, g=0.4 and a delay D1 and D2 of 176 samples at a sampling rate of 44.1 Khz are chosen, such values allowing to obtain a good sound rendering.

Figure 2:
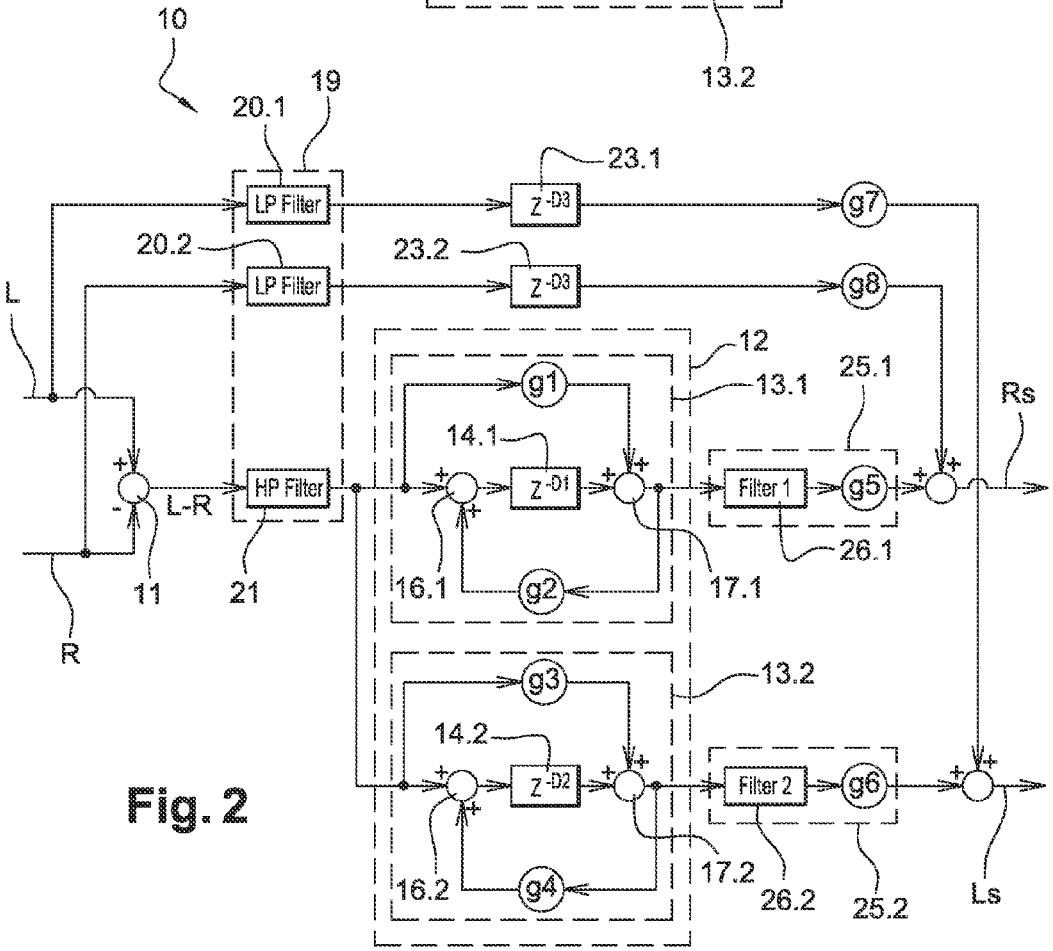
FIG. 2: a graphical representation of a device according to the invention allowing the extraction of the "surrounds" components of a stereo sound signal in an improved version.

In an improvement of the invention represented in FIG. 2, a stage 19 made up of two filters 20.1, 20.2 respectively allowing to isolate the low frequency part of the signals L and R and of a filter 21 allowing to isolate the high frequency part of the subtraction signal L−R is moreover used.

In this case, only the high frequency part of the signal L−R is applied to the input of the decorrelation module 12. In an example, the cut-off frequencies of the low-pass filters 20.1, 20.2 and of the high-pass filter 21 are about 350 Hz.

The low frequency parts of the left and right signals are applied to the inputs of third delay lines 23.1, 23.2 and the low frequency parts thus delayed are added, if it is necessary after weighting with gains $g_7$, $g_8$, to the output signals $s_1$, $s_2$ of the elementary blocks respectively, so as to obtain right $R_S$ and left $L_S$ surround sound signals with an improved sound rendering. In an example, the delay D3 applied by the third delay lines 23.1, 23.2 is equal to 176 samples at a sampling rate of 44.1 KHz Moreover, parametric equalization cells 25.1, 25.2 are connected with the output of each elementary block 13.1, 13.2 before addition to the delayed low frequency part. These cells 25.1, 25.2 cause a modification of the perception of the output signals $s_1$, $s_2$ of these blocks 13.1, 13.2 because, even if the signals $s_1$, $s_2$ have substantially identical levels, there are differences in the perception thereof because of the decorrelation relative to one another. Consequently, it can be useful to modify these signals from a perceptive point of view so that the general sound impression is as best as possible.

For this purpose, each equalization cell 25.1, 25.2 comprises a filter 26.1, 26.2 whose type, gain and phase can be adjusted according to various frequency bands of the signals $s_1$, $s_2$ and a gain $g_5$, $g_6$ which acts on all the spectrum of the signals $s_1$, $s_2$. These parameters are adapted by sound engineers in particular according to the application considered.

FIG. 3 shows a use of the invention within the framework of a sound broadcasting system with 4 channels (2 front channels and 2 rear channels) or with 5 channels (with an additional more central channel) making it possible to obtain an excellent sound rendering while limiting the computing power of the sound processing.

More precisely, for this use, the left L and right R stereo signals are applied to the input of the module 10 in FIG. 1 or 2 so as to extract the left $L_S$ and right $R_S$ "surround" signals which are broadcasted in the rear channels 29.1, 19.2; while the initial left L and right S stereo signals are directly broadcasted in the front channels 30.1, 30.2, if necessary after a parametric equalization by means of the modules 31.1, 31.2 (similar to the modules 25.1, 25.2 in FIG. 2).

Optionally, the component C common to the signals L and R is also extracted by means of a module 33 (an example of implementation of such a module is given in document FR-2886503) in order to be broadcasted in the central channel 34.

The invention claimed is:

1. A method for generating left and right surround sound signals from a stereo sound signal composed of a left sound signal and a right sound signal, comprising the steps of:

subtracting one of the left or right sound signal from the other sound signal by a subtraction module to obtain a single subtraction signal in which correlated and in-phase components of the left and right sound signals have been suppressed;

filtering the subtraction signal by a high-pass filter and applying only a high frequency part to input of first and second elementary blocks, wherein an output signal of each elementary block is a combination of an input signal of said each elementary block weighted by a first gain, the output signal of said each elementary block weighted by a second gain and the input signal of said each elementary block delayed by a delay line;

filtering a low frequency part of the left and right sound signals of the stereo signal;

delaying the low frequency parts with a delay by third delay lines; and adding the delayed low frequency part to the output signals of the elementary blocks to obtain the right surround sound signal and the left surround sound signal.

2. The method of claim 1, further comprising the step of broadcasting the surround signals in rear channels of an acoustic system of the type 5.1.

3. The method of claim 1, wherein the output signal ($s_1$) of the first elementary block corresponding to one of the right or left surround sound signal is defined by $s_1(n)=e_1(n)\cdot g_1+S_1(n-D1)\cdot g_2+e_1(n-D1)$, where $e_1$ being the input signal of the first elementary block corresponding to the subtraction signal, $g_1$ and $g_2$ being respectively the values of the first gain and the second gain of the first elementary block, n being $n^{th}$ harmonic sample, and D1 being the value of the number of delay samples introduced by the delay line; and wherein the output signal ($s_2$) of the second elementary block corresponding to the other surround sound signal is defined by $s_2(n)=e_2(n)\cdot g_3+s_2(n-D_2)\cdot g_4+e_2(n-D2)$, where $e_2$ being the input signal of the second elementary block corresponding to the subtraction signal, $g_3$ and $g_4$ being respectively the values of the first gain and the second gain of the second elementary block, n being $n^{th}$ harmonic sample, and D2 being the value of number of delay samples introduced by the delay line.

4. The method of claim 1, wherein the gain values inside an elementary block are opposite one another, the value of the first gain being opposite the value of the second gain.

5. The method of claim 1, wherein the gain values of the first elementary block are opposite the gain values of the second elementary block, the value of the first gain of the first elementary block being opposite the value of the first gain of the second elementary block and the value of the second gain of the first elementary block being opposite the value of the second gain of the second elementary block.

6. The method of claim 1, wherein the gain values of the first and second elementary blocks have the same absolute value.

7. The method of claim 1, wherein the first gain of the first elementary block and the second gain of the second elementary block are equal to g; and wherein the second gain of the first elementary block and the first gain of the elementary second block are equal to −g.

8. The method of claim 1, wherein the delay introduced by the delay line of the first elementary block and the delay introduced by the delay line of the second elementary block are equal to each other.

9. The method of claim 1, further comprising the step of modifying a phase and the gain of the output signals of each elementary block according to a frequency by parametric filtering cells to modify sound perception of the left and right surround sound signals.

10. The method of claim 1, further comprising the steps of generating surround signals for broadcast by an acoustic system comprising front/rear loudspeakers from a stereo sound signal composed of a left sound signal and a right sound signal; and applying the surround signals to rear channels of the acoustic system.

* * * * *